United States Patent [19]

McLean

[11] 4,309,003

[45] Jan. 5, 1982

[54] TARGET SEEKING GYRO

[75] Inventor: William B. McLean, San Diego, Calif.

[73] Assignee: Walter G. Finch, Baltimore, Md.

[21] Appl. No.: 117,699

[22] Filed: Feb. 1, 1980

Related U.S. Application Data

[60] Division of Ser. No. 697,189, Jun. 17, 1976, Pat. No. 4,191,346, which is a continuation of Ser. No. 583,337, May 7, 1956, Pat. No. 4,093,154, which is a continuation of Ser. No. 337,899, Feb. 19, 1953, abandoned.

[51] Int. Cl.[3] ..... F42B 13/30; F41G 7/22

[52] U.S. Cl. ..... 244/3.16

[58] Field of Search ..... 244/3.16; 74/5.4, 5.41, 74/5.43, 5.46, 5.6 R, 5.6 E

[56] References Cited

U.S. PATENT DOCUMENTS

| | | | |
|---|---|---|---|
| Re. 26,887 | 5/1970 | McLean | 244/3.16 |
| 3,756,538 | 9/1973 | McLean | 244/3.16 |
| 4,093,154 | 6/1978 | McLean | 244/3.16 |
| 4,185,797 | 1/1980 | McLean | 244/3.16 |
| 4,191,346 | 3/1980 | McLean | 244/3.16 |

*Primary Examiner*—Charles T. Jordan

*Attorney, Agent, or Firm*—Walter G. Finch; Richard S. Sciascia

[57] ABSTRACT

A free spinning gyroscope is provided which has a spin axis, together with precession means for precessing the gyroscope. In addition, means are provided for detecting an electromagnetic field of energy and adapted to generate signals indicative of misalignment of the gyroscope spin axis with the electromagnetic field of energy. Means are provided for utilizing the generated signals to directly control the precessing means to align the gyroscope spin axis with the electromagnetic field of energy.

18 Claims, 10 Drawing Figures

Fig. 1.
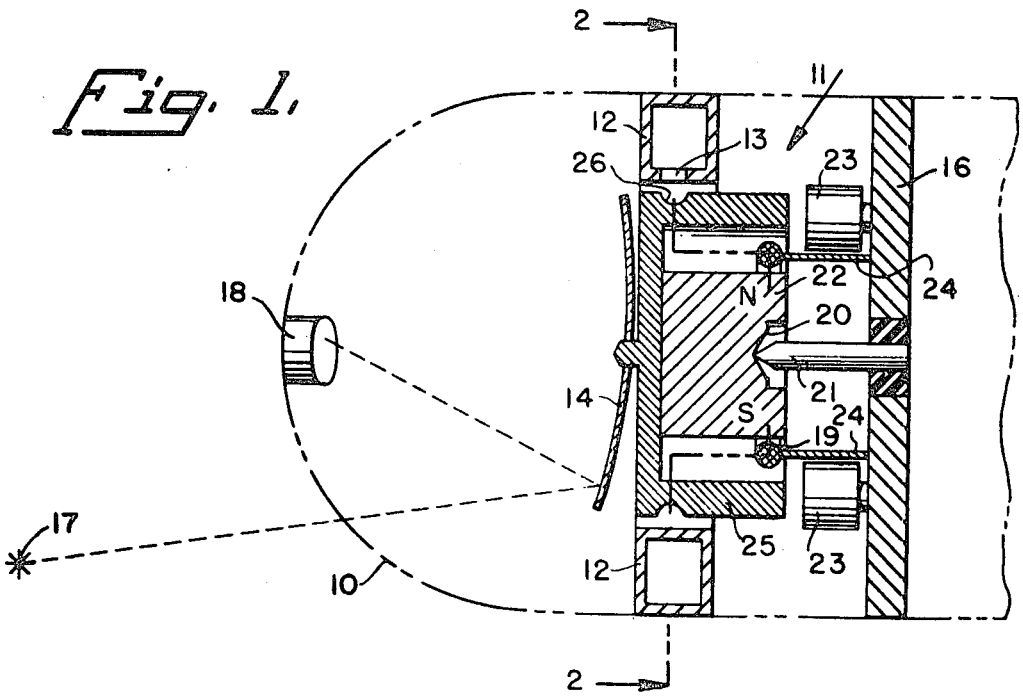
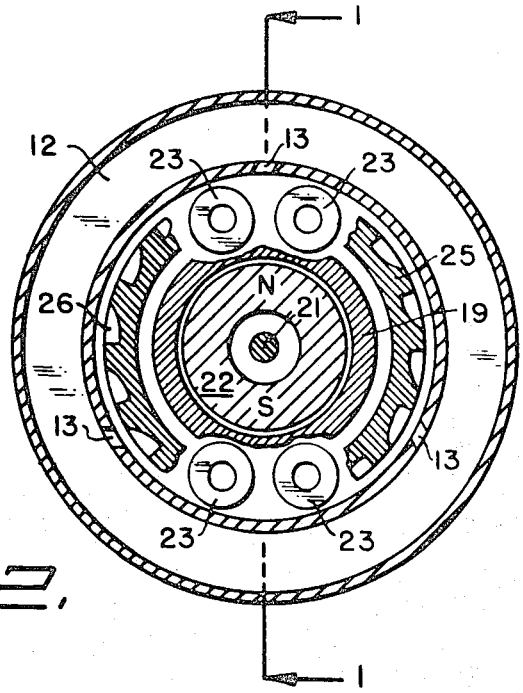
Fig. 2.

TARGET SEEKING GYRO

The invention described herein may be manufactured and used by or for the Government of the United States of America for governmental purposes without the payment of any royalties thereon or therefor.

This patent application is a divisional of my Ser. No. 697,189 now U.S. Pat. No. 4,191,346 issued Mar. 4, 1980 which is a continuation of Ser. No. 583,337, now U.S. Pat. No. 4,093,154 which is a continuation of Ser. No. 337,899, Feb. 19, 1953, now abandoned.

This invention relates to a homing missile and especially a quasi-optical target-seeking device of the type adapted to automatically direct or point itself at a source of electromagnetic radiation such as a source of infrared radiation. The target seeker of the present invention is a radiation responsive device which will track a moving target from which radiation is emanating. The seeker may be utilized, for example, to steer an air-to-air missile or the like along a course calculated to cause the missile to collide with a target; such as jet aircraft tailpipes or exhaust stacks on a propeller type plane which are sources of infrared energy.

The invention is concerned primarily with improvements in a gyro stabilized target seeker device that continuously tracks a target. To do this, the target seeker device must measure the angular difference, or error, between a line taken along the axis of rotation of the rotor of a free gyro which forms a portion of the target seeker device and the line of sight between the target seeker and the target and use this information to cause the gyro rotor to be precessed so that the axis of rotation of the gyro rotor, or the gyro axis, and the line of sight between the target seeker device and the target coincide. When the target seeker device is utilized in an air-to-air guided missile, for example, it is mounted at the forward end, or head of the missile with its longitudinal axis along the longitudinal axis of the missile, and the measurement of the angular difference between the gyro axis and the longitudinal axis of the missile is utilized to control the course along which the missile is steered. In addition to having means for measuring the angular difference between the gyro axis and the line of sight between the target seeker and the target, the seeker device or seeker head also embodies means for sensing angular differences between the gyro axis and the longitudinal axis of the missile. Such difference between the gyro axis and the longitudinal axis of the missile is sensed in the form of electrical signals which are amplified and utilized to control and move fins on the missile whereby the missile is directed toward the target.

The gyro rotor which forms a part of the seeker head mechanism carries a permanent magnet which rotates with it and a rotating focusing mirror which reflects an image of the target. The mirror is inclined at a slight angle to the axis of the gyro so that the target image reflected by the mirror travels in a circle. When the line of sight from the seeker head to the target and the gyro axis coincide, or the target lies on the gyro axis, the reflected image of the target at a radiant energy device (such as a photoelectric cell, which is mounted on the longitudinal axis of the seeker head and which forms a component of the seeker head) revolves around but does not fall upon the cathode of the radiant energy device. When the target does not lie directly on the gyro axis, but is off by a small amount, the circular path traveled by the reflected target image passes across the cathode of the radiant energy device to produce an electrical signal, the frequency of the signal equaling the spin frequency of the gyro rotor.

The permanent magnet is fixedly mounted on the rotor of the gyro so that a relationship exists between the position of the poles of the permanent magnet and the signal produced by the radiant energy device when there is an angle between the gyro axis and the line of sight between the seeker head and the target. To eliminate the angle, the gyroscope is precessed by the interaction between the magnetic field of the permanent magnet and the magnetic field of a surrounding non-rotating electrical winding, or precessing coil. The amplified output of the radiant energy device is applied across the precessing coil so that the interaction between the magnetic field of the permanent magnet and the magnetic field of the precessing coil produces a precessing torque on the gyro which is of the proper sense to correct, or eliminate, the angle between the gyro axis and the line of sight from the seeker head to the target. In other words, when the reflecting mirror is properly related to the positions of the poles of the permanent magnet, the poles, during spin, are angularly oriented relative to the periodic magnetic field of the coil (produced by the signal pulses energizing the coil) in such a manner that, as a result of interaction between the magnet and periodic magnetic field, a torque is applied to the spinning magnet which will cause the gyro to precess in a straight line to align the gyro axis with the line of sight from the seeker head to the target and the angle therebetween is thus eliminated.

The gyro of this invention is not mounted in gimbals but rotates and precesses about a single, central universal bearing, whereas, in previous devices it was necessary to resolve the error signal into two components and to then precess the gyro about its two gimbal axes. In previous devices the scanning, resolving, and gyro elements have been separate units, while in the present invention the scanning, resolving, and gyro elements are embodied in a single unit, thus considerably simplifying the apparatus and making it capable of tracking a target even under the condition of high roll rates of its supporting structure.

Similar systems known to the prior art have been subject to the disadvantage that the tracking takes place in two dimensions with the signal being resolved into two components, one for each dimension. In the present invention the tracking takes place in two dimensions without the necessity of resolving the signal into components for two coordinates and without the activation of two separate amplifiers, servos, or synchros, etc. That is, the permanent magnet and scanning mirror, which spin together gyroscopically about the gyro axis, are fixed to each other in such relation that the signal (produced when the gyro axis does not coincide with the line of sight) can be applied through a single amplifier and coil to the magnet in order to cause the magnet to precess and the gyro axis to align itself with the source of radiation; thus, only one coil and amplifier is needed in contradistinction to the two coils and amplifiers of precession mechanisms requiring resolution of tracking signals into two components. This is an extremely important feature when the system is mounted in a missile. In the prior air systems, the gyro is mounted in gimbals and the signals to precess the gyro are resolved with respect to the orientation of these gimbals. If the missile rolls about its longitudinal axis, these signals must change rapidly as the gimbal axis changes in order to keep the precession signal in the proper direction. In addition, in prior systems, the rolling of the missile in itself causes torques to be applied to the gyro; this is not true in the present invention. In the present invention the precessing means is such that the roll of the missile has no effect on the signal required to keep the gyro tracking the target. The single universal bearing support used for the gyro in the present invention permits swiveling or rotation (movement) at any angle within definite limits; this feature is important in a gyro subject to high inertial forces, and in that it gives freedom from critical balance tolerances and materially enhances ease of production and reliability of operation. The seeker device, or seeker head of the present invention is mounted on the forward end of a missile for the purpose of guiding the missile. The longitudinal axis of the seeker head is mounted so that its axis coincides with the longitudinal axis of the missile. In other words, the seeker head becomes the forward part and guidance portion on the missile. The warhead and propulsion system of the missile are rearward of the seeker head.

In the seeker head of the present invention the gyro rotor is mounted on a single central pivot bearing, and the precessing torque is not resolved into two separate components. The precessing torque is applied without physical connection between the gyro rotor and the precessing means. This is achieved by interaction between the magnetic field periodically produced by the fixed electrical winding of the precessing coil and the magnetic field of the movable permanent magnet carried by the gyro rotor. The time at which the signal pulses are applied across the precessing winding is related to the angular position of the north-south pole axis of the permanent magnet with respect to the precessing coil so that the interaction between the field of the permanent magnet and the field resulting from the current in the precessing coil produces a precessing torque on the gyro in exactly the right sense to realign the gyro axis with the line of sight between the seeker head and the target. Parenthetically, it may be said that in an infrared homing missile it is advantageous to use a sight-line telescope assembly having a relatively narrow field of view. It is desired that the seeker head keep the target in view when the missile oscillates; this is accomplished by the preferred embodiment of the invention. Accordingly, the significance of this invention is apparent in that the viewing system is stabilized so as to be independent of missile oscillations.

A primary object of the invention is, accordingly, to provide a gyro stabilized telescope for tracking a target or the like wherein the gryo axis is caused to continuously point at the target.

Another object is to provide a tracking apparatus as in the foregoing wherein the gyro is realigned, relative to the line of sight of the apparatus, by being precessed by means of interacting magnetic forces.

Another object is to provide a tracking device as in the foregoing wherein the direction of precession of the gyro in the proper sense is achieved by the relationship between electrical signal pulses generated as a result of deviation of the line of sight between missile and target from the gyro axis in a given direction, and the angular position of a permanent magnet carried by the gyro rotor.

Another object is to provide an automatic tracking device or target seeker for a homing missile comprising a gyro stabilizer embodying a rotor mounted on a single central pivot, so as to be free to be precessed in two dimensions, simultaneously for tracking a target emitting electromagnetic radiation.

Another object of the invention is to provide an automatic, radiation responsive tracking device or target seeker operative to simultaneously track a target and measure the angular difference between the line of sight and the longitudinal axis of the device.

Another object of the invention is to provide a target seeker as in the foregoing object wherein electrical means are associated with the motor and magnet for measuring the precessed position of the gyro axis for use in controlling the course of travel of a vehicle with reference to the line of sight from the vehicle to a target.

Further objects and numerous advantages of the invention will become apparent from the following detailed description and annexed drawings wherein:

FIG. 1 is a diagrammatic view of the forward section of a seeker assembly illustrating operation of the invention and shown in its relationship to the forward part of an air-to-air missile;

FIG. 2 is a cross sectional view taken along line 2—2 of FIG. 1;

FIG. 8 is a wiring diagram of the phase discriminator and amplifier circuits controlling the missile servo motors;

Referring to FIG. 1 of the drawings, this figure is a schematic view of a fragmentary showing of the seeker device to most simply illustrate the principle of its operation; the various parts are shown in their relative position to each other, however, some supporting structure is not shown in order to more simply show the operational parts of device. Numeral 10 represents the nose of a missile, the forward part of the nose being transparent to allow the movable optical portion of the seeker head to scan a target. The gyro rotor is shown at 11 and, as may be seen, it is within a circular air manifold 12. The gyro rotor is pnuematically driven by air discharging through jets 13, shown in FIG. 2. The rotor carries a mirror as shown at 14 which is mounted at a small angle to the axis of the gyro and this angle may be $2\frac{1}{2}°$, for example. However, other angles may be used depending upon the desired position and size of the other components in the seeker device. The gyro rotor, magnet and mirror form the movable optical portion of the seeker head.

In FIG. 1, numeral 17 designates a target which may by any source of radiation of light, heat or infrared rays, such as a jet airplane tailpipe. Numeral 18 designates diagrammatically a photocell or other radiation responsive device which receives the target signal.

Figure 3:
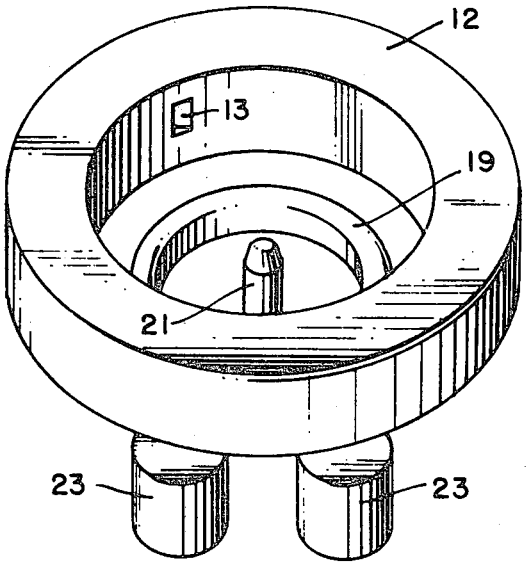
FIG. 3 is a perspective view of a part of the assembly.
Figure 9:
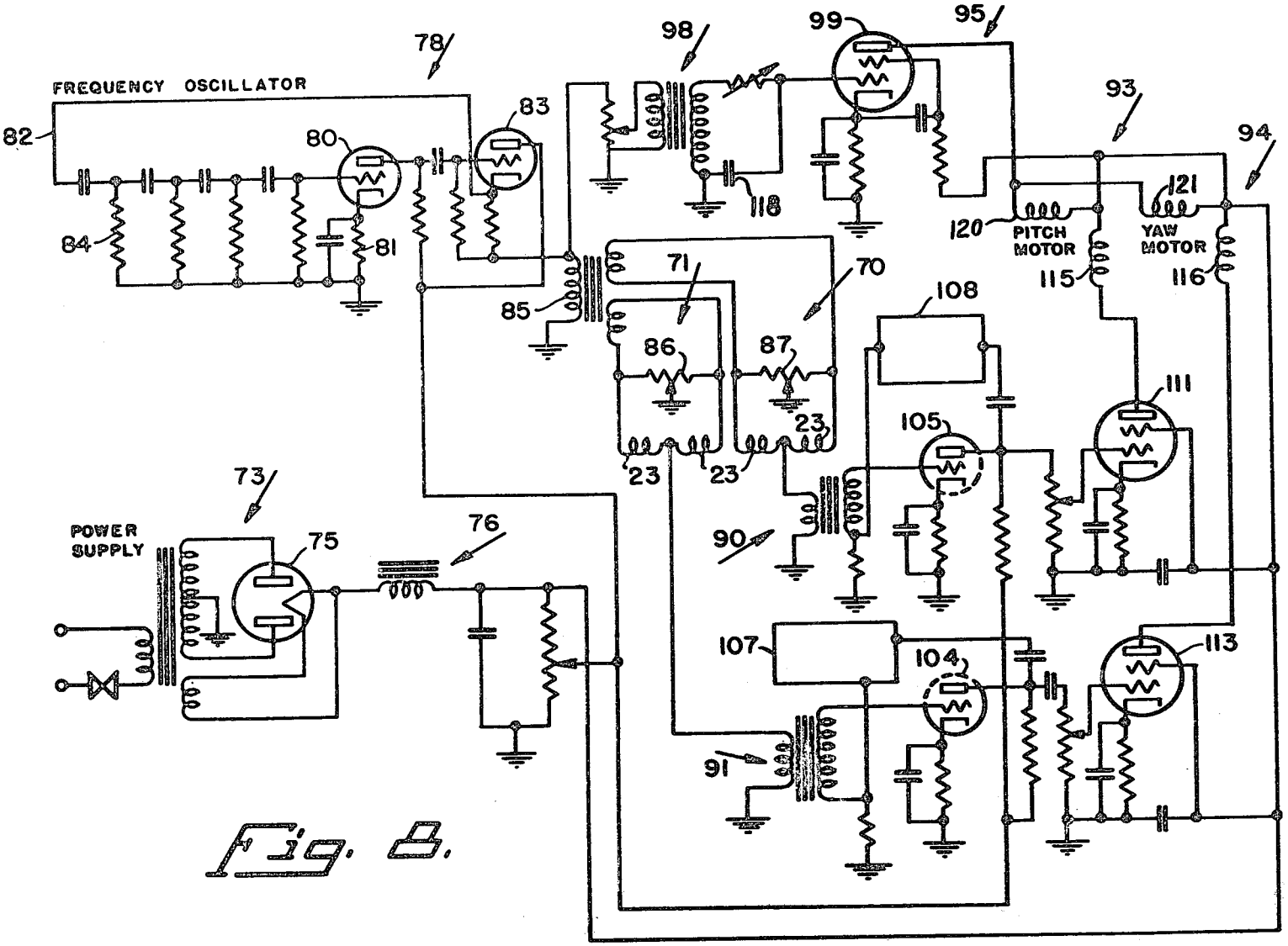
FIG. 9 is a diagrammatic view of a preferred form of the invention.
Figure 9:
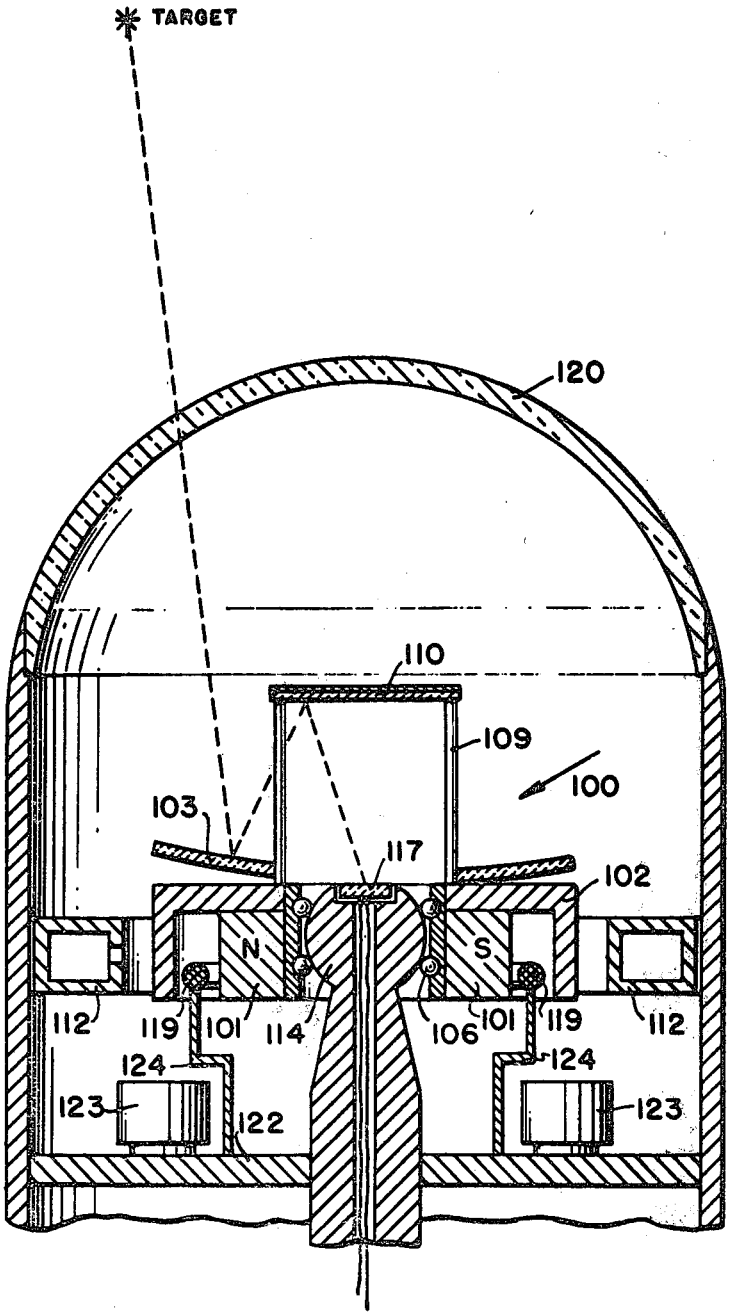

Referring now to FIGS. 1, 2 and 3 of the drawings, numeral 19 designates the precessing coil, which is mounted on the gyro frame 16 by supports 24 and surrounds the rotating magnet 22, as will be explained more in detail presently. Numeral 20 designates the central bore or support for the rotor 11, engaging a central pivot point as shown at 21, aligned with the rotor axis whereby the rotor is free to rotate and be precessed with two degrees of freedom. Bore 20 and pivot 21 are shown for illustrative purposes only; in actuality a universal bearing, as shown in FIG. 9 for example, or miniature gimbals would be used. The air manifold 12 has three internal angularly spaced jets 13, as shown, whereby air or gas under pressure is discharged inwardly against scallops 26 on the rotor 11, for rotating it at high speed.

Figure 7:
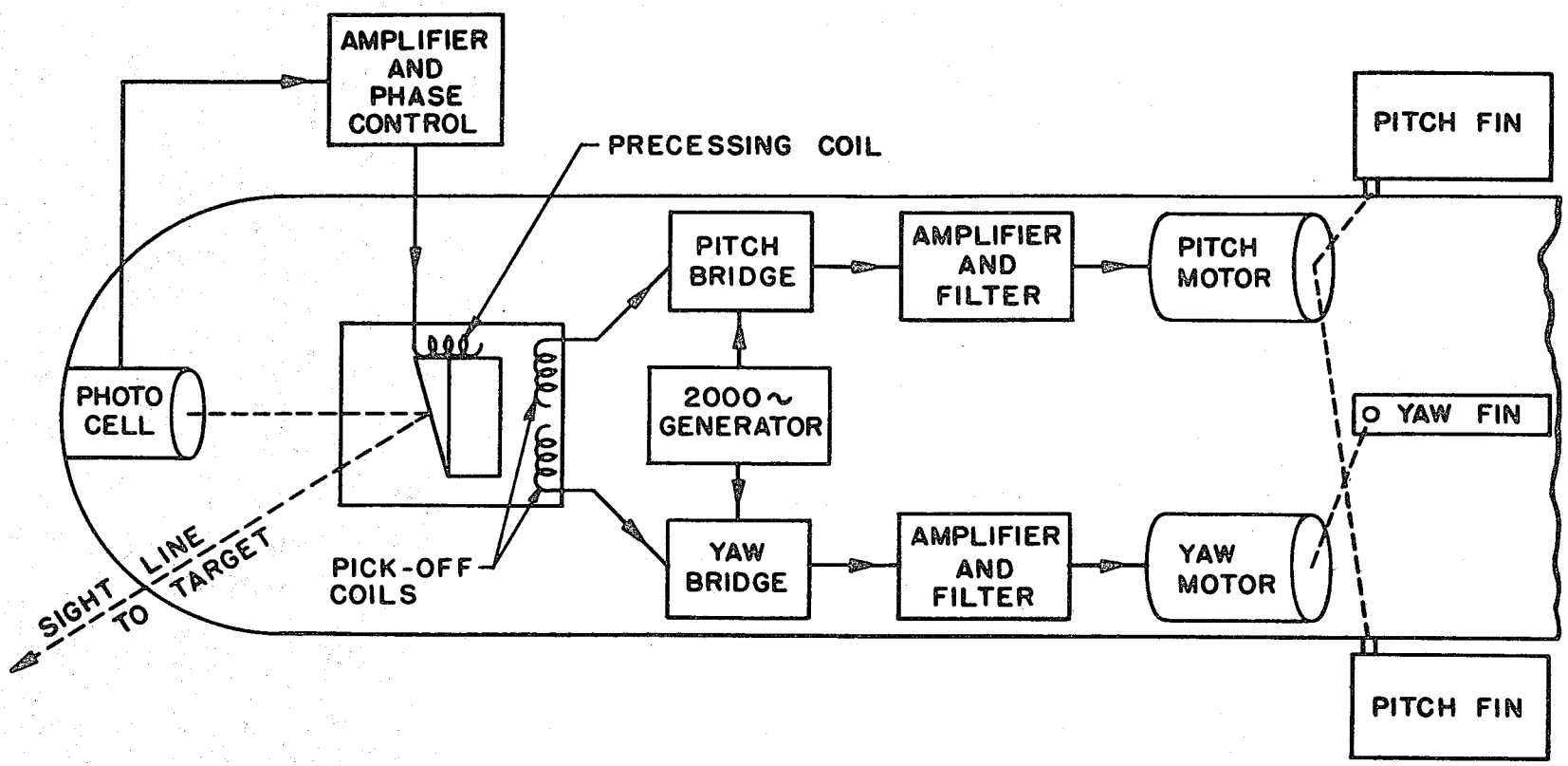
FIG. 7 is a diagrammatic view of a missile showing the various components of the guidance system in block form.

The rotor 11 carries the permanent magnet 22 which rotates with the rotor. Bore 20 is formed in the magnet 22 as shown. The rotor 11 has a depending skirt 25, as shown, so that an annular space is formed between the skirt and the magnet. The fixed precessing coil 19 is a solenoid coil disposed in this annular space, mounted on frame 16 by supports not shown, leaving the rotor free to tilt through a substantial angle. Disposed below the skirt 25 in close proximity thereto are electrical pick-off coils 23 which are used in measuring the tilt of the gyro rotor by variations in their inductance. The depending skirt 25 provides a return magnetic path for the magnetic flux of permanent magnet 22 and its relative proximity to the pick-off coils 23 determines their inductance. These pick-off coils each comprise two windings in series and a plurality of them may be provided in the respective quadrants of the rotor. For simplicity, pick-off coils 23 are shown for a single plane of precession only and they are mounted on the gyro support frame 16. The pick-off coils 23 are shown by the way of example as one manner of sensing tilt of the rotor 11 and are exemplary of electrical or other means of sensing the degree of tilt without actual physical attachment thereof to the rotor. These coils control a servo-mechanism, such as shown in FIGS. 7 and 8, which may be used to adjust the control fins of a missile, for example, to guide the missile along a pursuit course to a target.

Figure 4:
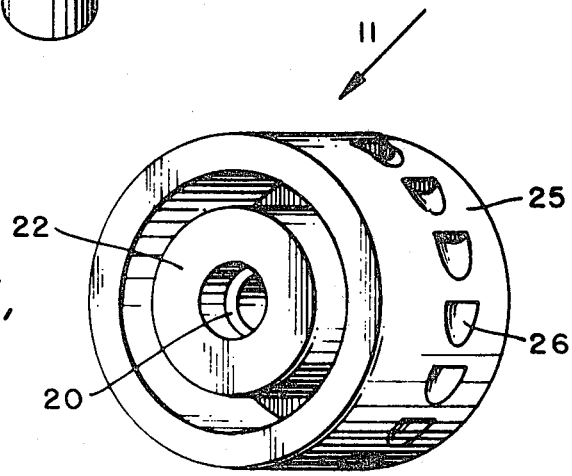
FIG. 4 is a view of the gyro rotor and permanent magnet.

Referring now to FIG. 4 of the drawings, this figure is a view of the rotor showing the permanent magnet 22 having a central bore 20 for mounting the rotor on its central pivot. The pivot point is located as near the center of gravity of the rotor as is practicable. Indicated at 26 are milled scallops around the periphery of the rotor and against which the air jets are directed for rotating the rotor.

Figure 5:
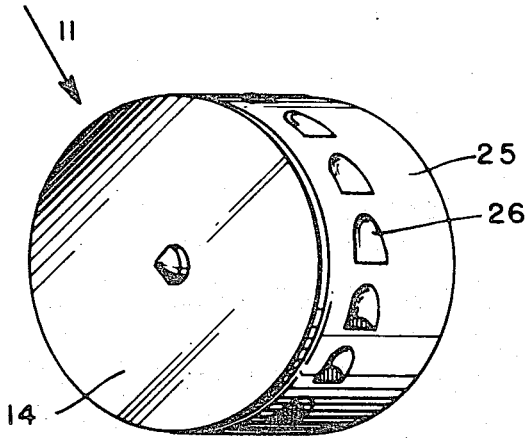
FIG. 5 is another view of the gyro rotor including the mirror.

Referring to FIG. 5, this figure is another view of the rotor including the mirror 14 which, as pointed out, for example, may be mounted at an angle of 2½° to the rotor axis. The mirror 14 is mounted at an angle so that the optical axis is at the same angle to the gyro axis causing the reflected image of a target to travel in a circular path when the gyro rotor 11 is rotating. (The pivot 21 in the center of the rotor is shock mounted on gyro frame 16 to dampen out vibration.)

Figure 6:
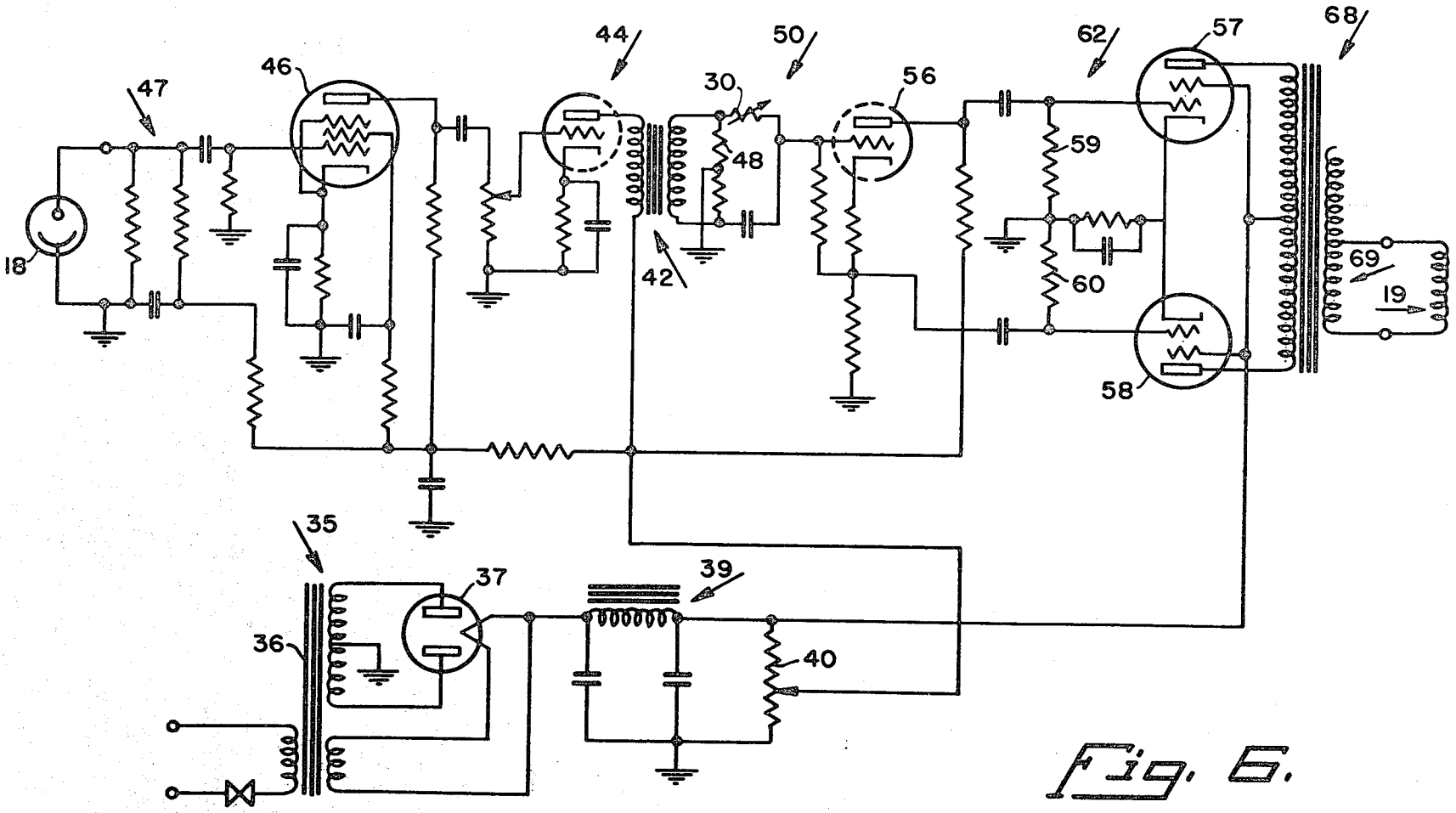
FIG. 6 is a wiring diagram of the photocell and precession amplifier.

Referring to FIG. 6, this figure shows a wiring diagram of the precessing amplifier which amplifies the photocell signal and feeds it to precessing coil 19.

It will be appreciated that by properly relating the tilt of the reflecting mirror 14 to the poles of the permanent magnet 22, the signal generated when the gyro axis does not coincide with the line of sight from the seeker to the target can be applied to the coil 19 for producing a magnetic field at the instant the poles of the magnet are so disposed that interaction between the magnetic fields of the coil and the magnet will give a torque which causes the gyro to precess itself in such direction as to align the gyro axis with the line of sight. However, to avoid the necessity of physically orienting the angle of mirror tilt exactly with respect to magnet poles in the fabrication of the gyro rotor, the phase angle of the output of the precessing amplifier of FIG. 6 may be shifted the amount necessary to cause current to flow through the precessing coil 19 at the time the orientation of magnet 22 is such that a torque will be developed which will cause gyro 11 to be precessed in the proper direction so that the angular difference or error between the gyro axis and the line of sight between the seeker device and the target will be eliminated. In operation, the effect of incorrect phasing is to cause the gyro to correct an error in pointing by spiraling to the new position, whereas, correct phase adjustment is indicated when the rotor precesses in a straight line to the new position.

The precessing amplifier circuit includes a conventional power supply 35 including a transformer 36 having primary and secondary windings and a fullwave rectifier as shown at 37. Associated with the power supply 35 is a filtering network 39 of conventional form supplying a potentiometer 40. Potentiometer 40 supplies power to a phase shaft transformer 42, the primary of which is in the plate circuit of amplifier tube 44. The photocell 18 is connected in the grid circuit of an amplifier tube 46 which is a five element tube having screen and suppressor grids as shown. The input circuit of tube 46 includes photocell 18 and filter circuits 47 to limit the range of frequencies to which the system will be sensitive.

The output of tube 46 is RC connected to the control grid of tube 44 which controls the primary of transformer 42.

The secondary of transformer 42 connects to a conventional phase shifting circuit network as shown at 50 including a center tapped resistor 48 connected across the secondary and grounded, and a manual rheostat 30. By adjustment of rheostat 30 the phase of the signal pulses being transmitted can be adjusted. The phase shifting circuit 50 is connected to a phase splitting tube 56, the output of which connects to a push-pull power amplifier circuit 62. Circuit network 62 includes push-pull connected tubes 57 and 58. Numerals 59 and 60 indicate grid resistors for tubes 57 and 58.

The power amplifier network 62 is connected to the primary of output transformer 68 and the secondary 69 of this transformer is connected to the gyro precessing coil 19.

By adjusting the variable resistor 30, the phase, or time of occurrence, of the pulses from photocell 18 can be adjusted relative to the angular position of the north-south pole axis of the permanent magnet 22 so that the direction of precessing is such as to achieve straight line precession of the gyro in realigning its axis with the line of sight from the seeker device to the target.

The pick-off coils 23 are connected to phase discriminators included in amplifier channels controlling servo-motors which adjust the fins of the missile. By way of example, there may be a pitch motor and a yaw motor, each controlled by pairs of pick-off coils to control the missile in pitch and yaw. FIG. 7 is a diagrammatic view of a complete missile seeker-head with the various components shown in block form. FIG. 8 is a wiring diagram showing the phase discriminator-amplifier channels connected to the pitch motor and yaw motor. In FIG. 8 the phase discriminator channels are indicated at 70 and 71. These circuits include Wheatstone bridges having the pick-off coils 23 forming legs thereof. The impedance of the coils 23 controls the balance or unbalance of the bridge, as will presently be described.

In FIG. 8 there is shown a conventional power supply at 73 which may be powered from a 110 volt 60 cycle source. The power supply includes a conventional fullwave rectifier as shown at 75 and a filtering network 76. The power supply feeds a 2,000 cycle oscillator 78 of conventional type including three element tubes 80 and 83 and a cathode resistor 81. Numeral 82 indicates a feedback circuit, the grid circuit including a parallel T filter network 84 necessary to establish and maintain the oscillation frequency of 2,000 cycles. The oscillator 78 supplies power to a transformer 85, which, in turn, supplies power to the yaw bridge 71 and the pitch bridge 70 and also to transformer 98. These bridges have the pick-off coils forming legs thereof, as described and potentiometer balance as shown at 86 and 87. The bridges connected to the primaries of transformers 90 and 91 included in the channels respectively to the pitch motor 93 and yaw motor 94. Pitch motor 93 and yaw motor 94 are split phase motors, each having a winding connected to a fixed phase motor amplifier 95, which is supplied with power from transformer 98 as shown. It should be noted that condenser 118 is provided to make the currents in windings 120 and 121, supplied by amplifier 95, ninety electrical degrees away from the currents in windings 115 and 116. Amplifier 95 includes a four element tube 99. Each of the servo motor channels includes an amplifier tube, such as the tube 105, connected to the secondary of the transformer 90. Across tube 105, which is the high gain stage, is a feedback provided by a parallel T, RC filter 108 tuned to 2,000 cycles. A frequency widely separated from that of the precessing coil is used in the servo loops to isolate them. The output of this circuit is further amplified by an amplifier stage 111 connected to one of the windings such as the winding 115 of the pitch motor 93. In the operation of one of the channels any unbalance, as between the pick-off coils 23, will unbalance the bridge circuit, 70, for example, causing the current to flow in the primary of transformer 90 having a phase dependent on the direction of the unbalance. This will result in a signal in the channel 90 which will be amplified and will be impressed on the windings 115 of the pitch motor 93 which will cause this motor to rotate in the proper direction to adjust the fins controlled thereby to adjust the missile to the proper heading in elevation. The other channel 71, 91, 104, 107, 113 and 116 similarly controls the yaw motor 94 to similarly control the missile heading in azimuth.

From the foregoing, it can be seen that signals are generated in the pick-off coils 23 depending on tilt of the gyro rotor 11, and that such signals result in controlling the missile fins, by means of a network as shown in FIGS. 7 and 8, to guide the missile so that the gyro axis and the longitudinal axis of the missile substantially coincide. This results in the missile following a pursuit course to the target.

Referring now to the overall operation of the system, the photocell 18 is mounted on the longitudinal axis of the seeker device, and the gyro rotor 11, as described, is rotated by air or other gas which is discharged from the jets 13 in manifold 12 and which impinges on scallops 26 on the rotor. As the mirror 14 rotates with the gyro rotor it scans an area which includes a target, target 17, FIG. 1 for example. The reflected target image appears at the photocell as a small dot of light rotating in a circular path at the spin frequency of the gyro. As long as the circular path traveled by the reflected image of the target surrounds the sensing area, the photocell 18, there will be no signal produced by the photocell. However, if there is an angular difference or error between the gyro axis and the line of sight from the target seeker device to the target, the circular path traveled by the reflected image of the target will cross the sensing area of the photocell producing a signal the frequency of which equals the spin frequency of rotor 11. The inner diameter of the circle formed by the rotating image is adjusted so that a slight displacement of the path of the image of the target at photocell 18 due to an error between the gyro axis and the line of sight from seeker device to the target (i.e., an angular difference between the gyro axis and the line of sight) will result in the sensing area of the photocell being touched by the rotating image to produce a signal at the spin frequency. This signal from the photocell is fed to the precessing amplifier where it is amplified and then applied to the precessing coil so that a magnetic field is generated by the precessing coil. This field produced by the precession coil when the image of the target crosses the photocell interacts with the magnetic field of the permanent magnet carried by the gyro rotor. The signal from the photocell will be in the form of pulses the time of occurrence of which, or phase, will vary with the direction of the error between the gyro axis and the line of sight to the target.

Figure 10:
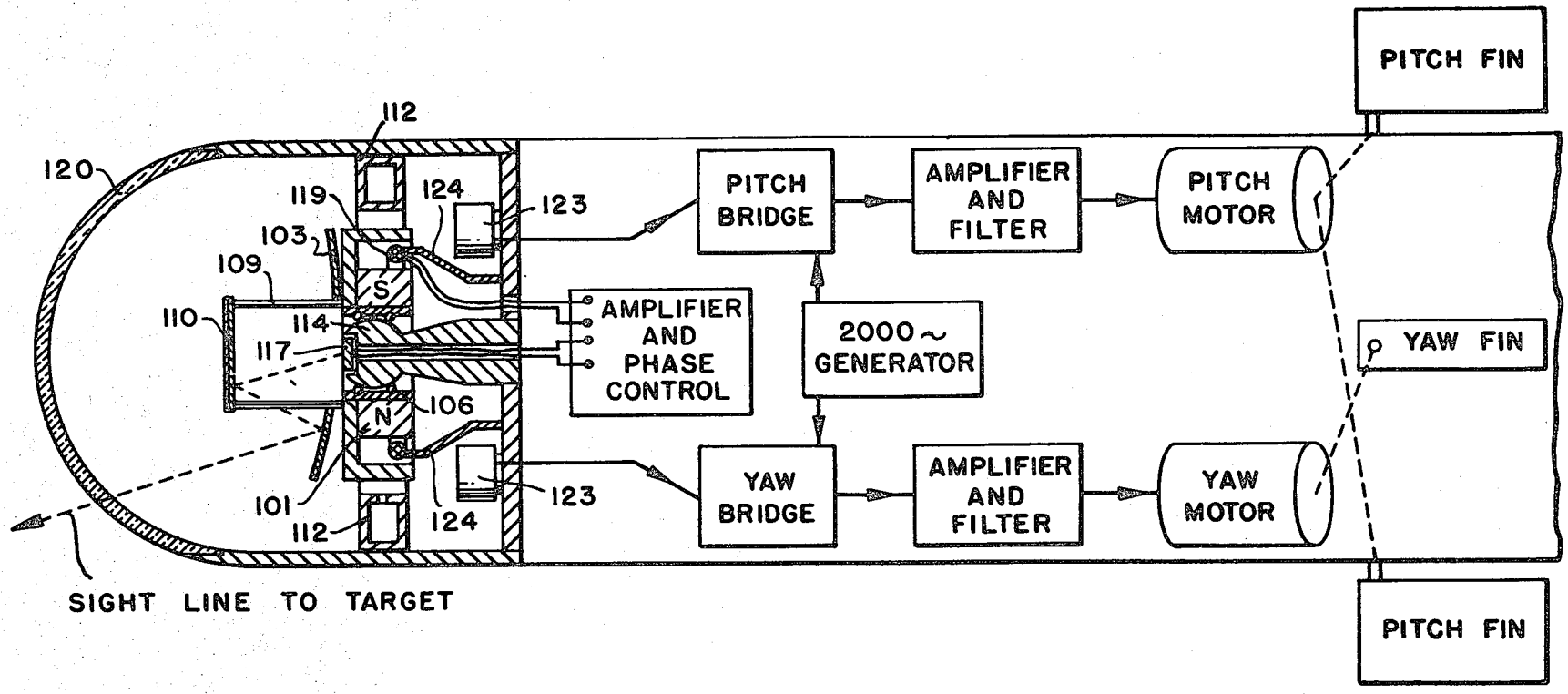
FIG. 10 is a view as in FIG. 9 in combination with a diagrammatic view in FIG. 7, showing a preferred embodiment of the invention.

The poles of the permanent magnet carried by the gyro rotor have a fixed orientation as respects the position of maximum tilt of the mirror. Thus, the time of the maximum amplitude of the signal impulse from photocell 18, and hence the maximum magnetic field of the precession coil 19, will occur at the time that the permanent magnet is in the position that the torque developed will cause the gyro to precess to realign its axis with the line of sight to the target. In other words, the permanent magnet mounted on the gyro rotor, and the coacting precession coil energized in accordance with a single-channel signal which exhibits a pulse at a given time in each 360 degree spin of the gyro rotor, operate to precess the gyro in a certain definite direction relative to the initial orientation of the spin axis, a direction corresponding to the particular cyclic instant at which the pulse occurs. In other words, the rotatable magnet on the rotor establishes a first magnetic force vector of fixed magnitude rotatable about the spin axis of the gyro at a frequency corresponding to the rate of rotation of the gyro rotor. The precessing coil (solenoid) when energized with the signal from the photocell produces a second magnetic force vector in the direction of the missile axis which is variable in magnitude in accordance with the displacement of the radiation source (target) with respect to the gyro spin axis and in time phase relationship with the polar angular position of said radiation source in relation to the first vector produced by the permanent magnet. When the signal current flows in the precessing coil, a variable magnet field is generated having the same frequency as the rotational frequency of the gyro rotor. In this manner the device operates to continuously track the target, the axis of the gyro being precessed in space as necessary so as to always point at the target. It can be seen that the direction of this precession is determined solely by the relative positions of the target, mirror, and magnet and is thus independent of missile orientation in roll, within the limits of freedom of gyro rotor 11. FIG. 9 shows a modification of FIG. 1 in which the seeker head keeps the target in view when the missile oscillates; it is independent of missile orientation in roll, pitch or yaw within the limits of freedom of the gyro rotor. FIG. 10 shows an embodiment as in FIG. 9 wherein the detector cell 117, precession coil 119 and pick-off coils 123 are shown electrically connected to the phase discriminator and amplifier circuits which control the missile.

In the foregoing, the angle of mirror tilt has reference to the diameter of the mirror representing the position of maximum tilt. Physically, of course, this particular diameter has a fixed position relative to the axis of the north and south poles of the magnet 22. The variable phase shift provided in the precession amplifier makes it unnecessary to actually physically adjust the angle between the mirror and the north-south pole axis of the magnet to secure straight line precessing. The phase adjustment is provided in a circuit component of the precession amplifier between two of the amplification stages. This component is a conventional type of phase shifting network manually controllable by an adjustable resistor, as shown at 30 in FIG. 6. Thus, by adjusting this resistor the relationship between the signal from photocell 18 and the north-south pole axis of the magnet is adjusted to achieve the desired precession. Precession of the gyro in the proper sense to realign its axis with the sight line to the target may be understood from the principle of the gyro, that with rotation about a first axis, a torque applied about a second axis will cause the gyro to precess about a third axis, all of the axes being normal to each other. Thus, with the north-south magnet axis in a given position, a torque applied from a signal in the proper phase position will result in precession in the proper direction to achieve the desired motion of the gyro axis.

The pick-off coils as shown at 23 are utilized to sense or measure the tilt, the amount the missile has moved from alignment with the gyro axis. These coils, as described, are mounted directly beneath the skirt of the rotor, and a position signal is derived from them by variation in their inductance, depending upon their proximity to the rotor skirt. These coils are connected to feed a signal to the amplifier (FIG. 8). The amplifier in response to the position signals controls the servomotors 93 and 94 to move the fins and guide the missile on a pursuit course to the target.

From the foregoing, it will be observed by those skilled in the art that a relatively simple but yet rugged and effective weapon is provided which is operable to "lock on" a radiating target and after being fired will continuously track the target while travelling on a pursuit course until the target is overtaken and destroyed.

Referring to FIG. 9 of the drawings, this figure shows schematically a preferred form of the invention calculated to realize certain advantages. In the first form of the invention a gyro is utilized to establish and maintain the longitudinal axis of the seeker device on the line of sight to the target which is a reference line, and a pursuit course is navigated along this reference line by causing the missile to follow the gyro. In the first form, FIG. 1, the photosensitive device is carried by the transparent nose 10 of the missile. The preferred embodiment of the invention involves an arrangement of parts including particularly an assembly of the optics and the photocell in such way that the photocell is mounted on the bearing about which the gyro rotor rotates and precesses. In FIG. 9 the gyro rotor is indicated at 100 and it comprises a permanent magnet 101 as in the first embodiment; it also has a skirt 102 providing a return magnetic path. Precessing coil 119 is mounted on base 122 by supports 124. Numeral 114 designates a fixed central bearing support for the gyro rotor which is in the form of a spherical ball and the rotor is mounted to move universally about this ball, the central bore of the rotor engages ball bearings 106 which are positioned between the central bore and the spherical ball 114. Fixed spherical ball and central support and spherical ball 114 is mounted on base 122. The rotor carries a tilted concave mirror 103 and numeral 109 designates support rods to which is attached plane or convex mirror 110 on the axis of the rotor mounting. The photocell, or radiant energy sensitive element 117 such as a lead sulfide cell, is mounted on the spherical ball 114 on the axis of rotation of the gyro. However, photocell 117 is on the fixed support and does not rotate or move with the gyro. The mirror assembly rotates with the gyro rotor and moves therewith. Infrared radiation, for example, from a target passes through the transparent nose 120 of the seeker head and is reflected off concave mirror 103 and plane mirror 110. The mirror assembly on the gyro lines up with the line from the seeker to the target and the reflected target image surrounds the photocell. If the gyro axis deviates from pointing to the target the reflected radiation from the target will impinge on the photocell to produce a signal which is fed to the precessing amplifier, as described in the foregoing and shown in FIGS. 7 and 10, and cause the gyro to be precessed in a straight line by precessing coil 119 so that the gyro axis will realign with the line to the target. When the gyro axis does not coincide with the longitudinal axis of the missile (i.e., the longitudinal axis of the target seeker device) the gyro rotor is tilted. The amount the rotor has tilted is sensed by the pick-off coils 123, which are mounted behind the rotor skirt, by variation in their inductance caused by their proximity to the rotor skirt. The pick-off coils are connected to an amplifier (see FIGS. 7 and 10) where the rotor position signals are amplified and used to control servo motors which guide the missile so that the longitudinal axis of the missile and the gyro axis will coincide and the missile will follow a pursuit course to the target.

Obviously, many modifications and variations of the present invention are possible in the light of the above teachings. It is, therefore, to be understood that within the scope of the appended claims the invention may be practiced otherwise than as specifically described.

What is claimed is:

1. In combination, a vehicle, a spinning gyroscope mounted in said vehicle and having a spinning frequency, means for generating a signal having a frequency proportional to the spin frequency of said gyroscope;

means on said vehicle for applying a torque to said vehicle; and means responsive to said signal and coupled to said torque applying means for causing said vehicle to move so as to reorient said vehicle in a predetermined direction.

2. In combination, a vehicle, a body mounted in said vehicle and adapted to be spin stabilized about a spin axis, means mounted on said spinning body for scanning and detecting an energy field and for giving output signals representative of the position of said energy field, and means for receiving said output signals and utilizing them to precess said spinning body through gyroscope forces to allow said scanning and detecting means to align itself with said energy field.

3. A vehicle capable of traveling in space and adapted to be spin stabilized about a spin axis, comprising, means for generating a signal having a frequency proportional to the spin frequency of said vehicle, means on said vehicle for applying a force to said vehicle, and means responsive to said signal and coupled to said force applying means for causing said vehicle to change its velocity.

4. In combination, a spatially stabilized vehicle having an axis of spin, and an orientation control system therefor, comprising means adapted to be carried by said vehicle and responsive to energy emitted from an external remotely located energy emitting source for generating a control signal; means carried by said vehicle for applying a torque controlled motion to said vehicle; and means responsive to said control signal and coupled to said torque motion applying means for causing said vehicle to move in a manner to provide orientation of said spin axis in a predetermined attitude or positional relationship with respect to emissions of energy emanating from said energy emitting source.

5. In combination, a spatially stabilized vehicle having one axis of spin and incorporating an orientation control system responsive to signal intelligence indicative of the spatial position of an external energy source located remote from said vehicle for generating an orientation control signal; means carried by said vehicle for and responsive to said signal for applying torqueing motion to said vehicle to effect orientation of said spin axis of said vehicle in a predetermined positional relationship with respect to energy emissions from said remotely located energy source, whereby said means coupled to said torque applying means is responsive to signal intelligence coupled thereto from said control signal generating source.

6. A vehicle having an axis of spin and of a character adapted for rotational stabilization in a space environment comprising; a control system including means for generating a signal having a pulse repetition frequency correlative to the rotational frequency of said vehicle; means on said vehicle for applying a turning moment force to said vehicle to effect movement of said vehicle along a path to provide a change in orientation to a predetermined new attitude and direction, correlative to synchronous correlation and application of control pulses with the instantaneous rotational position of said vehicle.

7. In combination, a vehicle, a body mounted in said vehicle and adapted to be spatially spin stabilized about a spin axis thereof and an orientation control system for said vehicle, said orientation control system comprising means mounted on said spinning body for scanning and detecting an energy field and providing output control signals representative of the position of said energy field relative to said control system, means for receiving said output control signals and including means for utilizing the output control signals to precess said spinning or rotationally stabilized body by virtue of gyroscopic type forces to facilitate said scanning and detecting means approaching alignment with said energy field.

8. In combination, a vehicle, a body mounted in said vehicle and adapted to be spin stabilized about a spin axis, means mounted on said spinning body for scanning and detecting an energy field to give detected signals, and means for receiving the detected signals and including means for utilization of the signals to control and precess said spinning body through gyroscopic forces to allow said scanning and detecting means to accomplish alignment of said body with said energy field.

9. In combination, a spinning vehicle, means for generating a signal having a frequency proportional to the spin frequency of said vehicle;

means on said vehicle for applying torque to said vehicle; and means responsive to said signal and coupled to said torque applying means for causing said vehicle to move so as to reorient said vehicle in a predetermined direction.

10. In combination, a vehicle, a body mounted in said vehicle and adapted to be spin stabilized about a spin axis, means mounted on said spinning body for scanning and detecting an energy field and for giving output signals representative of the position of said energy field, and means for receiving said output signals and utilizing them to precess said spinning body through gyroscopic forces to allow said scanning and detecting means to approach alignment with said energy field.

11. In combination, a spinning vehicle, means for generating a signal having a frequency proportional to the spin frequency of said vehicle;

means on said vehicle for applying torque to said vehicle; and means responsive to said signal and coupled to said torque applying means for causing said vehicle to move so as to reorient said vehicle in a predetermined direction, correlative to the contemporaneous application of torque movement to said vehicle in proportional synchronism existent between the spin frequency of said vehicle and the frequency of the generated signal.

12. In combination, a vehicle capable of traveling in space and adapted to be spin stabilized about a spin axis, and an orientation control system comprising means for generating a signal having a frequency proportional to the spin frequency of said vehicle, means on said vehicle for applying a force to said vehicle to effect a desired movement thereof, and means responsive to said signal generated by said generating means and coupled to said force applying means for causing said vehicle to change its orientation.

13. A vehicle capable of space travel and adaptable to spin stabilization about an axis thereof, in combination with an orientation control system; said control system comprising means for generating a signal having a frequency correlative to the spin frequency of said vehicle, means on said vehicle for applying a force to said vehicle to provide correction of error motion occurring with system drift; and means responsive to said vehicle to change the velocity of movement thereof in time correlated relationship to the frequency of said generated signal and the rotational spin frequency of said vehicle.

14. A vehicle capable of travel in space and of stabilized positioning relative to a source of emitted energy and incorporating a control system for providing correctional movement to said vehicle subsequent to initial travel and at least partial spin stabilization thereof; comprising in combination with said control system, means for generating a signal the frequency of which is proportional to the frequency of spin imparted to said vehicle for spin stabilization thereof; means on said vehicle for applying a force to said vehicle by directional movement thereof; and means responsive to said signal and coupled to said force applying means for causing said vehicle to change its velocity of motion.

15. In combination, a vehicle capable of traveling in space and adapted to be spin stabilized about a spin axis, together with means for generating a signal having a frequency proportional to the spin frequency of said vehicle, means on said vehicle for applying a force to said vehicle, and means responsive to said signal and coupled to said force applying means for causing said vehicle to change its velocity.

16. In combination, a spin stabilized vehicle;

means carried by said vehicle and responsive to energy emitted from an energy emitting source for generating a signal having a frequency equal to the spin rate of said vehicle when spinning; and means responsive to said signal for applying an intermittent torque to said vehicle about an axis different from said spin axis of said generating means to cause said vehicle to move so as to move said spin axis thereof to at least substantially approach or effectively achieve alignment to a predetermined orientation with respect to said source.

17. In combination, a body adapted to be spin stabilized about a spin axis, an orientation control system means for generating a signal having a frequency proportional to the spin frequency of said body, means on said body for applying torque to said body, and means responsive to said signal and coupled to said torque applying means for causing said body to precess the spin axis.

18. In combination, a body adapted to be spin stabilized about a spin axis, control system means including means carried by said body and adapted to directionally detect an object in space and for generating a signal in response thereto, and means responsive to said signal for applying a torque to said body for causing said body when spinning to precess and move said body correlative to its spin axis to approach alignment to a predetermined angle with respect to said object.

* * * * *